US006863594B2

(12) United States Patent
Preising

(10) Patent No.: US 6,863,594 B2
(45) Date of Patent: Mar. 8, 2005

(54) METHOD AND DEVICE FOR CLEANING HIGH-VOLTAGE CARRYING INSTALLATION COMPONENT PARTS

(76) Inventor: Paul-Eric Preising, Bayenthalguertel 24, D-50968 Koeln (DE)

( * ) Notice: Subject to any disclaimer, the term of this patent is extended or adjusted under 35 U.S.C. 154(b) by 69 days.

(21) Appl. No.: 10/221,617

(22) PCT Filed: Mar. 15, 2001

(86) PCT No.: PCT/DE01/00994

§ 371 (c)(1),
(2), (4) Date: Sep. 13, 2002

(87) PCT Pub. No.: WO01/68323

PCT Pub. Date: Sep. 20, 2001

(65) Prior Publication Data

US 2003/0104764 A1 Jun. 5, 2003

(30) Foreign Application Priority Data

Mar. 15, 2000 (DE) ..... 100 12 426

(51) Int. Cl.[7] ..... B24B 1/00

(52) U.S. Cl. ..... 451/39; 451/60; 451/102; 137/7

(58) Field of Search ..... 451/2, 72, 75, 451/39, 60, 102; 134/7

(56) References Cited

U.S. PATENT DOCUMENTS

| | | | | |
|---|---|---|---|---|
| 5,445,553 A | * | 8/1995 | Cryer et al. | 451/7 |
| 5,607,342 A | * | 3/1997 | Evdokimenko et al. | 451/75 |
| 5,782,253 A | | 7/1998 | Hoogerwerl et al. | |
| 5,795,626 A | * | 8/1998 | Gabel et al. | 427/458 |

FOREIGN PATENT DOCUMENTS

| | | |
|---|---|---|
| DE | 195 44 906 | 5/1997 |
| DE | 196 24 652 | 10/1997 |
| DE | 196 36 304 | 3/1998 |
| DE | 198 07 917 | 8/1999 |
| WO | WO 99 43 370 | 9/1999 |

OTHER PUBLICATIONS

"Werkstoffschonend Strahlreinigen mit Kohlendioxid-schnee", Bänder Bleche Rohre—4, pp. 26, 27 (1991).

* cited by examiner

*Primary Examiner*—Lee D. Wilson
(74) *Attorney, Agent, or Firm*—Paul Vincent

(57) ABSTRACT

A cleaning method and a corresponding cleaning device offer adequate protection to individuals, devices and installations, for cleaning component parts of installations that carry an electrical high-voltage and which are not disconnected during cleaning. Towards this end, the component parts to be cleaned are subjected to the action of a two-phase particle stream (PS) consisting of a compressed gas (DGA) serving as a carrier medium and of carbon dioxide ice particles (TP) carried therein. Possible superficial accumulations of dirt are removed from the component parts by way of low-temperature embrittlement and by the kinetic energy of the impacting carbon dioxide particles. The carbon dioxide ice particles themselves sublimate without leaving residues. A sufficiently safe distance of cleaning personnel from the high-voltage carrying insulation component parts is ensured by the provision of an electrically insulating distance mechanism (L, SFR) that is provided approximately in the form of a lance (L) or of a stream guided tube (SFR). A further increase in protection is offered by monitoring the quantity of moisture of compressed gas and/or ambient air, whereby the cleaning device is immediately shut off when predetermined limiting values are exceeded.

33 Claims, 3 Drawing Sheets

METHOD AND DEVICE FOR CLEANING HIGH-VOLTAGE CARRYING INSTALLATION COMPONENT PARTS

BACKGROUND OF THE INVENTION

The present invention relates to a cleaning method and a cleaning device for installation component parts that carry an electrical high-voltage.

Components in electric power supply facilities as e.g. components in transformer and switchboard stations are contaminated by dirt due to the influence of their operation, their environment and special events (such as e.g. fires). The dirt and the adherent contamination are of various nature. The possible range of dirt and contamination starts at slightly adherent, powdery, inorganic or organic dirt and extends over oils, fatty matters, liquid films and so-called biological films consisting of fungi and algae to nearly burnt-in residues consisting of metals, metal oxides and carbon which arise due to spark discharges and electric arcs.

Component parts of such facilities must be cleaned from time to time in order to maintain reliability of operation of the installations. For example, even if they have only a low conductivity, electrically conducting adherents at the surface of a ceramic isolator can decrease the isolating effect of the isolator. In extreme cases the can give rise to an electric arc and so at least for a short time cause an operation breakdown.

Consequences of such operation breakdowns range from short-time power interruptions to fires in an installation.

The well-known physical and chemical cleaning methods can be employed for cleaning. However, then, for the personal protection of the cleaning personnel, the operation of installations must usually be stopped and they must be powered down, i.e., it must be guaranteed that the electric high-voltage is disconnected. At least during the cleaning process this requires an operation shut-down which is economically disadvantageous and, moreover, often causes technical problems. The economic damage that electric supply and industry companies suffer due to the shut-down time required for cleaning high-voltage installations is important and would justify a considerable additional expenditure for the cleaning method in order to avoid shut-down.

Chemical cleaning methods are based on the effect that the dirt particles adhering to a component part are subjected to a chemical reaction by the cleaning agent thus being removed from the component part. Cleaning methods employing chemical cleaning agents usually leave behind liquid or solid residues that can be a risk to the operation safety of the installation depending on the nature of the residues. The residues themselves can play the role of a kind of contamination and can influence the isolation effect of component parts or they can develop corrosion at component parts. Thus, cleaning agents themselves must usually be expensively removed. This results in complicated and time-consuming cleaning processes.

Methods operating exclusively physically do not suffer from these disadvantages. These methods remove the contamination purely mechanically by abrasion from the component part. However, their cleaning often is less effective especially when oils and fatty matters are involved. In such a method, e.g. a high-pressure water jet directed to the component parts to be cleaned is employed for cleaning. Such wet-cleaning methods have severe drawbacks: on the one the high humidity can develop corrosion at the component parts and on the other hand dirty and thus contaminated waste water arises which must be disposed of or reprocessed. Without additional detergents or solvents it is only partly possible to remove fatty or oily residues. And finally, water has a relatively high electric conductivity. Thus, cleaning at operational voltage without exposing the cleaning personnel to danger is only possible in a low-voltage range (i.e. the range below 1 kV).

In a wider sense, particle blast methods as e.g. sand blasting can be classed among mechanical cleaning methods. Most of these methods (more precisely, most blast particle media) exhibit a strong abrasive effect that impairs the surface of the component parts to be cleaned.

A certain exception is the application of dry-ice particles as blast medium (i.e. particles of carbon dioxide in solid phase) as it is known from German patent applications DE 195 44 906 A1 and 196 24 652 A1, for example. Dry-ice particles are relatively soft (their hardness is similar to that of calcium sulphate) and so they do not damage the surface. Meanwhile, the application of solid carbon dioxide as blast medium for cleaning is quite common. Moreover, the cleaning is not only effected by the kinetic energy of the dry-ice particles impacting onto the surface, rather there are other contributing factors. So, the dry-ice particles sublime either upon or immediately after impact. The relatively high sublimation heat required is taken away from the impact point, thus locally strongly cooling the impact surface and the dirt adhering to it. The resulting thermal stress weakens the bondage between the dirt or contamination coating and the surface of the component parts to be cleaned. The contamination's freezing and embrittlement also reduces its adhesive strength. Finally, the sudden sublimation of dry-ice particles is a nearly explosive volume increase by a factor of about 600 blasting off the already loosened dirt.

A great advantage of such cleaning methods with solid carbon dioxide is the fact that dry-ice particles sublime to carbon dioxide in gaseous phase completely and without residual matter. Thus, no additional contaminated waste is produced. The waste to be disposed of consists only of the removed dirt and contamination.

Unfortunately, the instruments and methods for cleaning with dry-ice particles as, e.g., they are known from the previously mentioned documents cannot directly be employed for cleaning high-voltage installations that are not powered down since neither the personal protection of the personnel nor the safety of the instrument against high-voltage is provided. So, the cleaning workers must approach the installation to be cleaned to much, so that the danger of a high-voltage flashover arises.

Moreover, two important problems that can arise in principle must be taken into consideration, namely condensing atmospheric humidity that creates an additional conductivity and the effects of the removed dirt particles.

One must expect that by feeding the extremely cold dry-ice particles (the sublimation point of carbon dioxide lies at −78° C.) the humidity contained in the ambient air and eventually in the pressure gas will condense and thus reduce the isolating power of the ambient air. Especially for indoor installations, this could have fatal effects since their isolation distances have not been designed for condensing humidity. Thus, this could give rise to flashovers and electric arcs which would not only endanger the installation safety but also the cleaning personnel's safety. Since the minimum safety distances have been designed for normal installation operation but electric arcs could bridge a wider range, even when working at distance cleaning personnel would run a considerable risk of being hurt especially by scalds.

An other point of danger is the fact, that possibly the pressure air transporting the carbon-ice particles contains humidity that could induce a certain conductivity, thus, endangering the cleaning personnel as well as the cleaning device.

The second problem are the removed dirt particles. The dry ice will not simply be sprayed over the installation, rather it impacts at the surface to be cleaned with high kinetic energy and there looses the dirt particles. As already mentioned before, these often consist of combustible and partly of electrically conductive materials. When being finely divided in the ambient air of a high-voltage installation, it must be expected that they reduce the isolation power and could themselves cause electric arcs or could intensify the effects of electric arcs. Even dust explosions cannot not be excluded, rather they must be expected.

The importance of these dangers strongly depends on the actual installation especially on the height of the applied high-voltage. What would be no or nearly no problem in a 3 kV installation and only a slight problem in a 30 kV installation could grow to a deadly danger in a 300 kV installation.

Therefore, it is a objective of the present invention to provide a cleaning method and a cleaning device employed for that method that allow to clean high-voltage carrying installation component parts in a simple and for the operator as well as for the device safe way without the requirement of powering down said installation component parts.

SUMMARY OF THE INVENTION

This objective is inventively achieved with a method, a device, and an application with the features of the independent claims. Advantageous embodiments and modifications of the inventions are described in the dependent claims.

Extensive experimental research by the inventor did furnish the surprising result that the anticipated problems due to humidity condensation and raising dirt particles, in fact, do not occur, but that, paradoxically, the isolation resistance of the mixture consisting of ambient air, pressure gas, carbon dioxide gas, cold dry-ice particles, condensation water, and dirt particles is not lower but mostly higher than the isolation resistance of common ambient air.

Since, according to the experimental results, the required isolation distances do not increase, the basic idea of the inventive cleaning method and the device employed for it is to apply a dry-ice particle jet to the installation component parts to be cleaned but to guarantee by an isolating distancing means that there always is a sufficient minimum distance between the cleaning personnel and the impact point of the particle jet at the surface to be cleaned, this minimum distance being determined in a way that the personal protection is guaranteed even if the installation has not been powered down. The experimental results prove that employing an isolating distancing means is sufficient to guarantee a cleaning that is safe for installation and cleaning personnel.

Employing the inventive cleaning method and the corresponding device, for the first time, it is possible to clean installation component parts with applied high-voltage without endangering the safety of the cleaning personnel and without employing cleaning agents that leave behind solid or liquid residues. The cleaning quality is adapted to the requirements of electric installations: fatty matters, environmental dirt and damages due to fire accidents can be completely removed without damaging the component parts of the installation.

Modifications of the inventive cleaning method and the corresponding device provide an additional monitoring of the humidity of pressure gas and/or ambient air. Thus, the personal protection and the safety of the installation is always guaranteed even at extremely unfavorable conditions such as high humidity or a shortage of dry-ice particles. An other modification improves safety by monitoring the isolation power of the distancing means. A further modification of the inventive method and the inventive device proposes a removal of the loosened dirt particles by suction. Thus, the cleaning process will become easier and faster.

Further favorable embodiments and modifications of the invention are described when explaining the examples of inventive embodiments below.

BRIEF DESCRIPTION OF THE DRAWINGS

Embodiments of the invention will subsequently be described with the help of the figures. The figures show.

DESCRIPTION OF THE PREFERRED EMBODIMENT

The figures are not true to scale for clarity reasons.

The heart of each device for cleaning with dry-ice particles is the jet generator that produces the cleaning two-phase jet consisting of the pressure gas as carrier medium and the carried dry-ice particles. Following, it is simply designated as particle jet.

Figure 1:
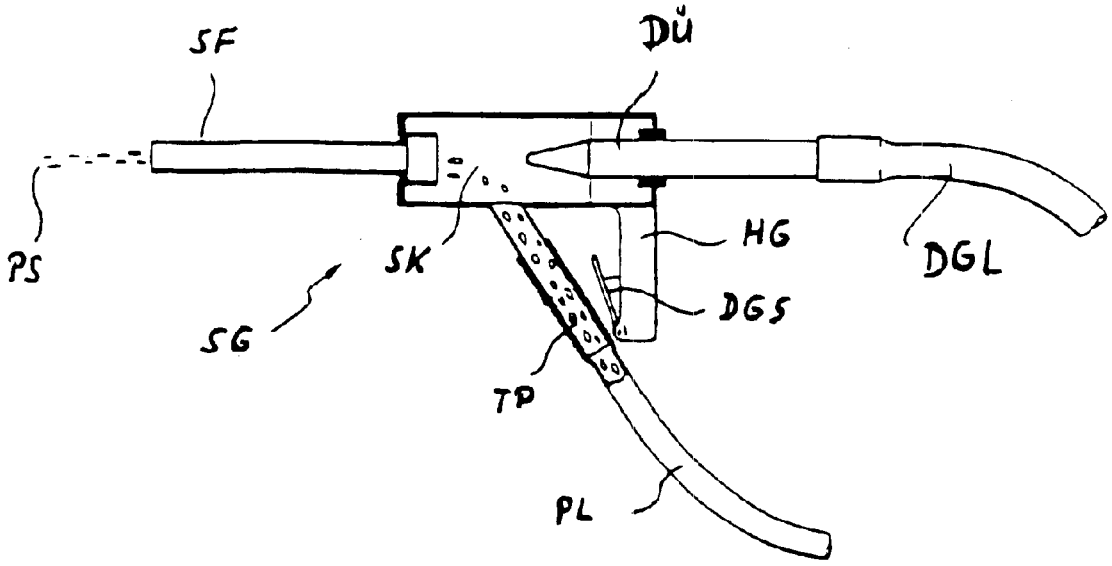
FIG. 1 a jet generator for generating a particle jet according to prior art

FIG. 1 depicts a jet generator as it is known from prior art. It can be employed as a component of the inventive device. A pressure gas is provided via a pressure-gas line DGL (a tube, e.g.), dry-ice particles TP are provided via a particle line PL. Through a nozzle DÜ the pressure gas emerges into the jet chamber SK. The thereby highly increased velocity of flow generates a partial vacuum in the jet chamber SK. Due to said vacuum dry-ice particles TP are sucked via the particle line PL, dragged into the pressure gas stream and carried by it further along. Then, the particle jet PS consisting of pressure gas as carrier medium and dry-ice particles leaves through the jet emitting opening SA into open air. In order to chose the direction of the jet and for easy positioning of the cleaning jet, a short pipe SF for jet direction control can be attached as depicted in FIG. 1. The end of the short pipe SF is formed by the jet emitting opening. It is also possible that the length of the short pipes is reduced to the thickness of the wall of the jet chamber SK, i.e. it can be completely withdrawn.

With conventional components (with no high-voltage applied) the particle jet leaving the jet emitting opening SA is simply directed to the component part to be cleaned and there effects the described cleaning process. The cleaning worker holds the jet generator SG at a handhold HG (additionally attached to it, there are a pressure gas switch DGS that allows to enable or disable the jet generation and, eventually, additional control elements for pressure and flow-rate control). Therefore, the cleaning worker must approach the component part to be cleaned to a distance of a few centimeters—this would be a hazardous task when cleaning installation component parts carrying a high-voltage due to the danger of an electric shock. This is especially true since jet generators according to prior art have a metallic and thus conductive housing.

The inventive device can also employ other jet generators. Among these are jet generators that effect an additional tangential acceleration of the dry-ice particles. Such a jet generator is known from PCT application WO 99/43470, for example. An other suitable jet generator known to those skilled in the art contains a mixer where a feeder (e.g. a screw conveyor) injects dry-ice particles into the pressure gas stream provided through a pressure gas line. A transport tube carries the generated two-phase stream consisting of pressure gas and dry-ice particles over a possibly wide distance to the actual jet pistol which has the jet emitting opening SA at its front side. The only function of the jet pistol is then to allow the cleaning worker to direct the jet to a component part and if necessary to enable or disable the jet. This arrangement has the advantage that instead of two separated pressure gas lines there is only a single transport tube for the two-phase stream.

Figure 2:
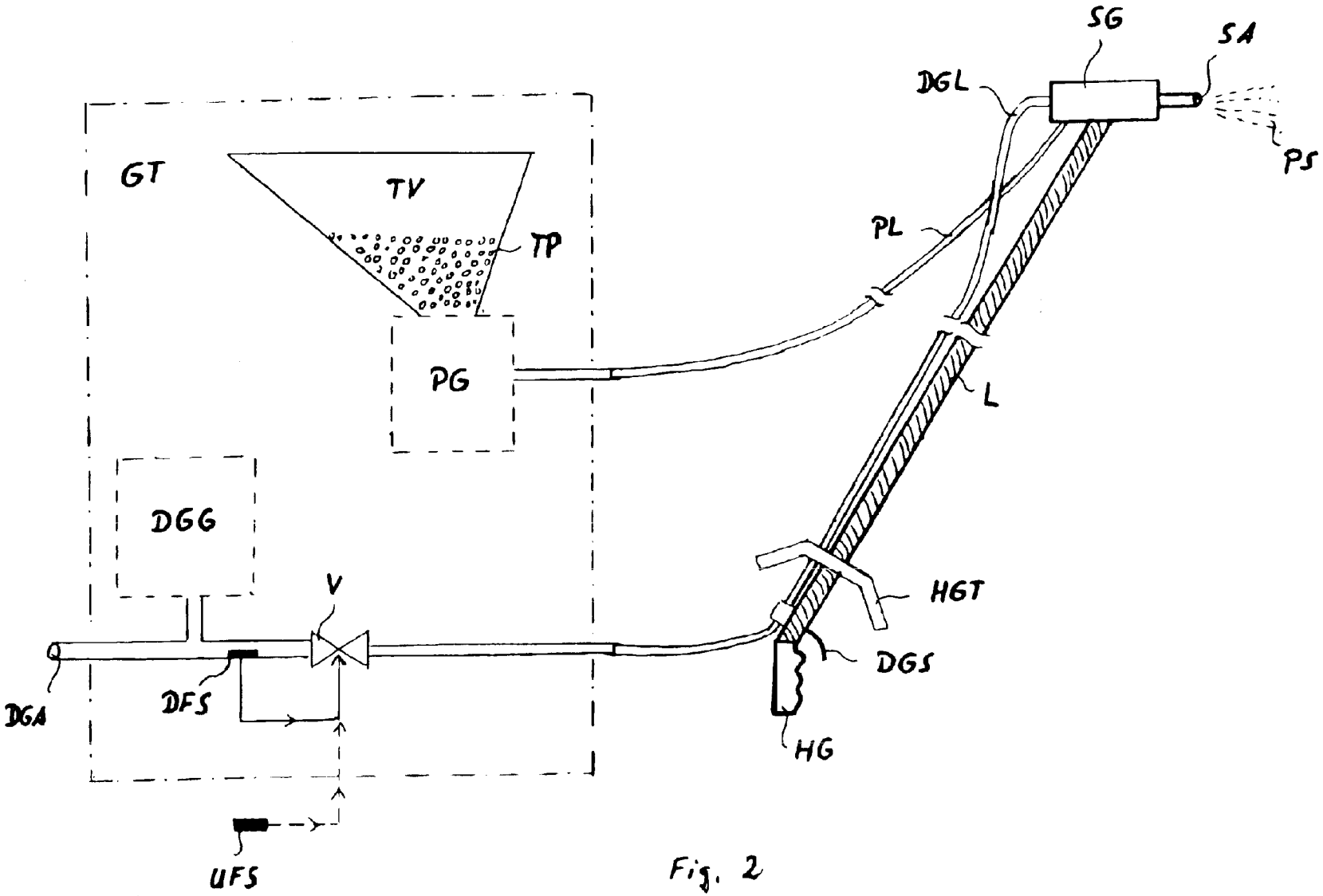
FIG. 2 a schematic view of an embodiment of the inventive device for accomplishing the cleaning method FIG. 3 a modified distancing means for the inventive device

FIG. 2 shows a schematic view of the inventive device. Essential components correspond to the components of a particle jet device according to prior art as it is described in DE 19544906 A1, e.g. The required pressure gas (i.e. a gas with pressure above atmospheric that is later employed as carrier medium) is either supplied by an internal pressure-gas generator DGG (e.g., a compressor or a gas cylinder) or it is provided via an external pressure-gas inlet DGA e.g. by a stationary pressure-gas generator of the facility to be cleaned. For cost reasons, the pressure-gas preferably is compressed air. But in principle any other gases (especially inert ones, such as e.g. nitrogen or argon) can be utilized.

The pressure gas flows from the external pressure-gas inlet DGA or the internal pressure-gas generator DGG, respectively, via a valve V for interrupting the pressure-gas supply (especially in case of an emergency shutdown) through the pressure-gas line DGL to the jet generator SG. The dry-ice particles attain from a dry-ice reservoir TV through the particle line to the jet generator SG. The dry-ice particles can be procured already preformed, e.g. as particles with the size of a rice corn and then be filled into the reservoir TV. However, it is also possible to produce them on the spot. This can be accomplished by adiabatic expansion of carbon dioxide gas, for example. Possible processes are known to those skilled in the art and need not be explained here in detail. In this case the device comprises a particle generator instead of the dry-ice reservoir TV. Moreover, the dry-ice particles can be subjected to a further treatment such as being crushed to very small or sharp-edged particles before reaching the jet generator. Suitable methods and arrangements are known from document DE 19636304 A1, for example. The components described so far with exception of the jet generator (as depicted in FIG. 1) are arranged together onto a common carrier as indicated in FIG. 2.

As far as described the device corresponds to a conventional cleaning device. The great problem of a conventional arrangement is that the small working distance requires the cleaning workers to closely approach the installation to be cleaned. With an applied high-voltage the personal protection cannot be guaranteed. In order to solve this problem, the inventive device employs a kind of electrically isolating lance as distancing means L. The jet generator SG is attached to one end of the lance. At the other end there is a handhold HG for holding and directing the lance L. Above the handhold HG there are attached one or more hand-protection HGT plates. They firstly prevent that the lance is hold at a position above the handhold HG by the cleaning worker and secondly avoid a continuous liquid film ablong the lance at high ambient humidity.

The lance itself must be electrically isolating. It preferably consists of a synthetic material with a high breakdown voltage as e.g. polycarbonate. Hygroscopic synthetic materials (as e.g. nylon) are less suited. However, the lance L must not be made completely from an isolating material, in principle, it is sufficient if there is an isolating distance corresponding to the voltage applied during cleaning. The length of the lance L or more precisely spoken the distance between the handhold HG and the jet emitting opening SA is designed in such a way that it corresponds to the required minimum safety distance (to keep away from the installation component part with applied high-voltage). The required safety distance depends an the ambience conditions and especially on the height of the applied voltage. In Germany, VDE rule VDE 0105 prescribes the required safety distances. Actually according to that rule the minimum safety distance in a 400 kV installation is 3.40 m. Taking into account the length of the handhold the lance for such an installation should have a length of about 4 m. Apart from the lance in such an arrangement the pressure-gas line DGL and the particle line PL must be electrically isolating, since they are in direct neighborhood of the jet emitting opening SA. This should be no problem, when the lines are made of synthetic materials.

Of course, in such an arrangement the pressure-gas switch DGS cannot be positioned directly near the jet generator SG. It is preferably positioned in the pressure-gas line at the handhold HG. Thus, the cleaning worker can control the jet generator SG without removing his hand from the handhold HG.

According to a preferred modification of the inventive device the lance which has the first function of a distancing means is also utilized for carrying the pressure gas and/or the carbon-dioxide particles to the jet generator SG. For this purpose, it is sufficient to design the lance as a tube or a doutube, leading the pressure gas and/or the carbon-ice particles through this or these tubes, respectively, to the jet generator. Thus, it is still easier to position the pressure-gas switch DGS at the handhold HG. The integration of at least one of the lines to the jet generator into the lance L employed as distancing means has the advantage of less weight and is easier to handle.

Another preferred modification of the inventive cleaning device is already depicted in FIG. 2: the jet generator SG and the jet emitting opening SA are arranged in a way that the direction of the jet is not just in line with the lance. The direction of the jet and the privileged direction of the lance are not collinear. This deviation of the jet direction facilitates cleaning of installations that are not accessible from all four sides. With the jet direction deviating at least 90° (from the lance direction), e.g., the rear sides of the high-voltage carrying component parts can be cleaned from the front. It is especially favorable if the deviation can be controlled and adapted to the cleaning conditions by means of a lock-type hinge.

In another preferred embodiment of the inventive cleaning device, the distancing means is not a lance but rather onto the jet generator (as depicted in FIG. 1) a slightly cone-like jet guiding tube SFR with a diameter increasing slightly over its length is attached. Then, the jet emitting opening SA is formed by the front end of the jet guiding tube SFR. This jet guiding tube that is made of an electrically isolating material, preferably made of a synthetic material such as polycarbonate acts as distancing means. Again, its length corresponds at least to the minimum safety distance required for the applied high-voltage. The jet guiding tube SFR guides the particle jet generated by the jet generator SG, i.e. it provides for a laminar flow and prevents turbulence. This embodiment of the cleaning device more lightweight and thus easier to handle than the embodiment described before. Here too, a hand-protection plate HGT is provided for the same reasons as already described for the distance means of FIG. 2. The hand-protection plate especially protects a hand rest HG' positioned beside the handhold HG. Thus, a two-handed working with the cleaning device becomes possible. For designing the minimum length of the jet guiding tube SFR obviously, the minimum distance between jet emitting opening SA and handhold HG or hand rest HG', respectively, must be considered.

For this embodiment as well, a jet deviation or deflection can be provided just before the jet emitting opening SA in order to clean covered parts of the installation component parts.

Condensing humidity is a safety problem when high-voltages are involved. This especially applies for in-door high-voltage installations that have not be designed for condensing humidity in contrast to most open-air installations. The cold dry-ice particles and especially the cooling due to their sublimation can easily cause condensation. Particularly, problems can arise if the supply of the dry-ice particles (that are important for the isolation power as described at the beginning) is temporarily interrupted, but the pressure gas still has a high humidity and the component parts to be cleaned first keep their low temperature due to their high heat capacity. Therefore, in a modification of the inventive cleaning method, the humidity is monitored in order to maintain a sufficient personal protection and installation safety. Important quantities are thereby the relative humidity of ambient air and especially that of the pressure gas and/or of the pressure-gas/particle jet. Thus, the modification of the inventive cleaning method provides for a monitoring of the humidity in the ambient air and/or the pressure gas or in the particle jet, respectively. When exceeding given humidity limits, the essential cleaning process will not be started or will be interrupted immediately (this can be effected by an immediate interruption of pressure-gas supply) or the installation to be cleaned will be powered down immediately. The required limit values depend especially on the height of the applied high-voltage. Studies have proven that e.g. a 400 kV installation can be cleaned in any case at a relative ambient air humidity below 80%.

It is more difficult to define the limit value for the humidity of the pressure gas as carrier medium for the particle jet. The essential quantity is the humidity in the particle jet. But the humidity of the pressure gas must not absolutely be measured there. It can be measured anywhere between the pressure-gas generator DGG or the external pressure-gas inlet DGA, respectively, and the particle jet behind the jet emitting opening. Depending on the measuring location, the pressure gas has an other pressure and thus an other humidity value. But there is an one-value (mathematical) function between these values. So, the corresponding limit values can be converted into one another. The cleaning device of FIG. 1 comprises a pressure-gas humidity sensor DFS positioned at the pressure-gas supply in order to accomplish humidity monitoring of the pressure gas. Design and function of such a sensor can be found in literature on the subject and is well known to those skilled in the art. When exceeding the predetermined limit value the cleaning process will be stopped or not at all started. For this purpose the pressure-gas humidity sensor DGS can interrupt the preassure-gas supply by means of valve V. If the pressure-gas humidity sensor is positioned at the jet generator, in the jet guiding tube or even shortly before or behind the jet emitting opening it must be guaranteed that the electrical isolation of the distancing means is impaired by the electric wires of the sensor. This can be achieved by a sufficient isolation of the wires. But a fiber-optic transmission of the measurement values or directly employing an optical or fiber-optic humidity sensor.

A pressure-gas humidity sensor in the pressure-gas supply provides the additional advantage that independent from safety aspects the humidity of the supplied pressure-gas can be monitored continuously. To high a humidity in the pressure gas can cause the dry-ice particles to bake together and to form clots. Then, in best case only cleaning efficiency deteriorates, in worst case an occlusion and obstruction of the dry-ice particles' transport paths can temporarily occur. In a further favorable embodiment of the invention a control unit interrupts pressure-gas supply (e.g. by means of a solenoid valve) as soon as the humidity measured by the pressure-gas humidity sensor DFS exceeds a limit value at which the foramtion of clots must be anticipated.

The device can comprise an ambient-air humidity sensor UFS for measuring ambient air humidity. That ambient can also close the valve V when exceeding a humidity limit value.

The aforementioned humidity sensors can be replaced by dew-point sensors. Particularly, a monitoring for condensing water vapor (i.e. dew formation) can be provided for. This corresponds to a limit value for relative humidity of 100%. Particularly when measuring ambient air humidity, this measurement can be completed with a temperature measurement in order to allow a more precise determination of the humidity limit value.

In a further modification of the inventive cleaning method, the jet guiding tube is heated in order to prevent the formation of liquid films due to surface condensation.

Figure 3:
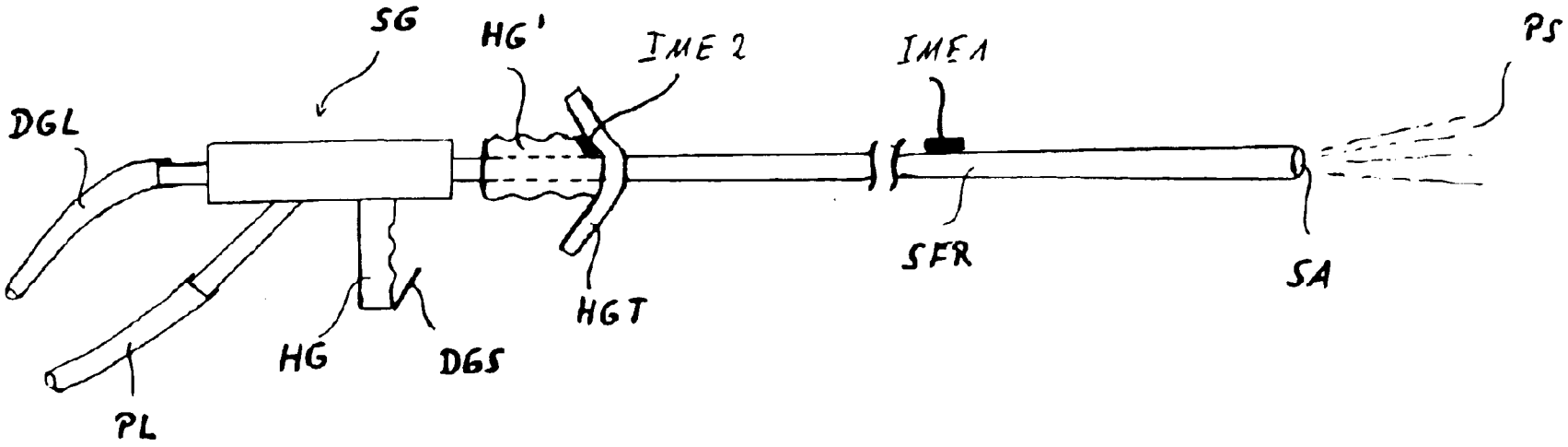

In an other modification of the inventive cleaning method or the corresponding cleaning device, the isolation properties of the distancing means (such as, e.g., resistance, impedance or breakthrough voltage) are monitored (by a leakage current measurement for example). FIG. 3 depicts a suitably modified distancing means. At the distancing means, preferably in the middle of the distancing means, there is a first electrode IME1 and a second electrode IME2 is positioned near the handhold HG. Thus, the impedance between the first electrode IME1 and the second electrode IME2 can be measured. It is known to those skilled in the art how such a measurement can be accomplished (especially an alternating current measurement for a sufficient galvanic separation and a high-voltage measurement to include non-linear effects). The impedance measurement can be performed before the essential cleaning process or at continuous time intervals in between or continuously during the cleaning process. Alternatively, a single electrode IME1 that preferably is positioned in the middle of the distancing means and that is connected to installation ground potential. The leakage current across this first electrode IME1 is a good measure for the isolation properties of the distancing means. When exceeding a predetermined threshold level (or falling below a threshold level when measuring resistance or impedance) the control unit can either emit a warning to the cleaning worker or effect an emergency shut-down of cleaning device or installation to be cleaned.

Finally, another modification of the inventive cleaning method and the corresponding device provides for a removal of the dirt particles loosened or blast off by the particle beam by means of pneumatic suction. This is accomplished by a suction extractor similar to a vacuum cleaner. The removal by suction can be performed during the essential cleaning process (i.e. while applying the particle jet to the installation component parts to be cleaned) as well as afterwards or continuously intermitting the essential cleaning process with the particle jet.

At the beginning, the high isolation power of the mechanical mixture consisting of ambient air, pressure gas, dry-ice, humidity and removed dirt particles has been described. Since depending on various parameters it is difficult to express these relations quantitatively. Experimental studies by the inventor show that even at a relative air humidity of 90% a safe cleaning of 400 kV installations is possible with the inventive method as long as the quantity of dry-ice particles in the pressure gas amounts to at least 50 g per cubic meter pressure gas, the pressure-gas humidity is so low that its pressure dew point is lower than 20° C. (minimum pressure of the pressure gas is 1.5 bar) and the average ratio of surface area to volume of the dry-ice particles is higher than 0.2 $mm^{-1}$.

So far in the description always cleaning personnel has been mentioned. But it is within the scope of the invention that the cleaning personnel or cleaning worker are robots or robotal devices or more generally speakig automated cleaning systems. Usually then with respect to these machines the personal protection aspect is less critical than in the case that human beings are involved. The aspect of installation safety will then get higher priority. In Germany then the required minimum safety distances will no longer be prescribed by VDE rule VDE 0105, rather they will be adapted considering the requirements of the installation to be cleaned and the risk potential for the cleaning apparatus. Thereby not only isolation properties are important but also e.g. EMI properties (electromagnetic interference) play an important role. The mechanical connection elements between the robot or robotal device and distancing means and/or their fixation at the distancing means must be considered as handhold HG or hand rest HG' in this case.

When mentioning high-voltage without further specification in this description it should be understood that this expression means electric DC or AC voltages above 1 kV. The invention has previously been described with reference to specific embodiments. Various variations and modifications as they are obvious to those skilled in the art do not depart from the scope of the present invention.

What is claimed is:

1. A method with which a user can clean a surface of high-voltage carrying installation components or of components used in high-voltage carrying installations, the method comprising the steps of:

a) generating, in a jet generator, a two-phase jet consisting essentially of a pressure gas and carried dry-ice particles;

b) guiding said two-phase jet to a component having a jet emitting opening to release said two-phase jet into air;

c) directing, following step b), said two-phase jet towards the component to be cleaned; and d) maintaining a minimum distance between the user and said jet emitting opening using an electrically insulating distancing means, said distancing means disposed between and communicating with said component having said jet emitting opening and a handhold or hand rest for the user, wherein said minimum distance corresponds to a minimum distance to the high-voltage carrying component as required for personal protection or installation safety.

2. The method of claim 1, wherein said handhold or hand rest communicates with control elements for the user.

3. The cleaning method of claim 1, further comprising monitoring a humidity content of said pressure gas and preventing or interrupting the cleaning process should said humidity content of said pressure gas exceed a predetermined limit.

4. The cleaning method as claimed in claim 3, wherein said preventing or interrupting of the cleaning process is effected by an interruption of pressure gas supply.

5. The cleaning method as claimed in claim 1, further comprising monitoring a humidity content of ambient air and preventing or interrupting the cleaning process should said humidity content of said ambient air exceed a predetermined limit value.

6. The cleaning method of claim 5, wherein said preventing or interrupting of the cleaning process is effected by an interruption of pressure gas supply.

7. The cleaning method of claim 1, further comprising monitoring an electrical insulation of sold distancing means and preventing or interrupting the cleaning process should said electrical insulation fall below a predetermined threshold value.

8. The cleaning method of claim 7, wherein said preventing or interrupting of the cleaning process is effected by an interruption of pressure gas supply.

9. The cleaning method of claim 1, further comprising monitoring an electrical insulation of said distancing means and preventing or interrupting the cleaning process should electric current flowing through at least a part of said distancing means exceed a predetermined limit.

10. The cleaning method of claim 1, further comprising suctioning to remove dirt particles and contamination loosened by said two-phase jet.

11. The cleaning method of claim 1, wherein step c) comprises generating or guiding said two-phase jet to leave said jet emitting opening in a direction which is not collinear to a principal direction of said distancing means.

12. The cleaning method of claim 1, wherein a dry-ice quantity in said pressure gas is at least 50 g dry ice per cubic meter pressure gas and a humidity of said pressure gas is sufficiently low that a pressure dew point of said pressure gas is below 20° C.

13. A device with which a user can clean a surface of high-voltage carrying installation components or of components used in high-voltage carrying installations, the device comprising:

means for generating a two-phase jet consisting essentially of a pressure gas and carried dry-ice particles;

means for guiding said two-phase jet to a component having a jet emitting opening to release said two-phase jet into air;

means for directing said two-phase jet towards the component to be cleaned; and means for maintaining a minimum distance between the user and said jet emitting opening using an electrically insulating distancing means, said distancing means disposed between and communicating with said component having said jet emitting opening and a handhold or hand rest for the user, wherein said minimum distance corresponds to a minimum distance for high-voltage carrying component as required for personal protection or installation safety.

14. The device of claim 13, wherein said generating means comprises one of an internal pressure gas generator to produce said pressure gas with a pressure above atmospheric pressure and a pressure gas inlet to accept externally supplied pressure gas having a pressure above atmospheric pressure, said generating means also comprising one of a dry-ice reservoir for said dry-ice particles and a particle generator for producing said dry-ice particles, said generating means having a jet generator to generate said two-phase jet, and further comprising means for connecting said jet generator to one of said pressure gas generator and said pressure gas inlet as well as means for connecting said jet generator to one of said dry-ice reservoir and said particle generator.

15. The cleaning device of claim 14, wherein said distance means is a lance at least partly made of an insulating material, wherein said jet generator is attached to an end of said lance.

16. The cleaning device of claim 15, wherein said distance means is a jet guiding tube comprising or communicating with said jet generator at a first end of said distance means and forming said jet emitting opening at a second end of said distance means.

17. The cleaning device of claim 16, wherein said jet guiding tube comprises a jet deflection near an end thereof shortly before said jet emitting opening.

18. The cleaning device of claim 14, wherein said jet generator is attached to an end of said lance with an angular deviation.

19. The cleaning device of claim 14, wherein said distancing means is additionally employed for jet guidance.

20. The cleaning device of claim 19, wherein said distance means is a jet guiding tube comprising or communicating with said jet generator at a first end of said distance means and forming said jet emitting opening at a second end of said distance means.

21. The cleaning device of claim 20, wherein said jet guiding tube comprises a jet deflection near an end thereof shortly before said jet emitting opening.

22. The cleaning device of claim 14, wherein said jet generator is integrated into said distancing means.

23. The cleaning device of claim 22, wherein said distance means is a jet guiding tube comprising or communicating with said jet generator at a first end of said distance means and forming said jet emitting opening at a second end of said distance means.

24. The cleaning device of claim 23, wherein said jet guiding tube comprises a jet deflection near an end thereof shortly before said jet emitting opening.

25. The cleaning device of claim 14, further comprising a humidity sensor communicating with at least one of said pressure gas and said dry-ice particles and a shut-down unit communicating with said pressure gas and said humidity sensor, wherein said shut-down unit prevents or interrupts a pressure gas supply should a predetermined humidity limit value be exceeded.

26. The cleaning device of claim 14, further comprising an ambient air humidity sensor for measuring a humidity of ambient air.

27. The cleaning device of claim 26, further comprising a shut-down unit to interrupt or inhibit pressure-gas supply as soon as said ambient air humidity sensor indicates at least one of a predetermined humidity value level being exceeded or condensation of water vapor.

28. The cleaning device of claim 14, further comprising an insulation monitoring unit for monitoring insulation properties of said distancing means to trigger safety action when said insulation properties fall below a predetermined limit value.

29. The device of claim 28, wherein said triggered safety action comprises at least one of a warning to cleaning personnel, interrupting pressure gas supply, inhibiting a start of pressure-gas supply, inhibiting another essential component of the cleaning device, and powering down the installation component part to be cleaned.

30. The cleaning device of claim 28, wherein said insulation monitoring unit comprises an electrode communicating with said distancing means to measure a leakage current to ground.

31. The cleaning device of claim 14, further comprising an additional pneumatic suction unit for removal of dirt particles and contamination loosened or blasted off by said two-phase jet.

32. The cleaning device of claim 14, wherein a quantity of dry ice in said pressure gas is at least 50 g dry-ice per cubic meter pressure gas, a humidity of said pressure gas being sufficiently low that a pressure dew point of said pressure gas lies below 20° C.

33. Use of a the device of claim 14 for surface cleaning of installation component parts carrying an electric high-voltage or of installations component parts in installations carrying a high-voltage.

* * * * *